US006184482B1

(12) United States Patent
Priem

(10) Patent No.: US 6,184,482 B1
(45) Date of Patent: Feb. 6, 2001

(54) SWITCH MANIPULATION PREVENTION DEVICE

(76) Inventor: William Priem, 15015 Champaign, Allen Park, MI (US) 48101

( * ) Notice: Under 35 U.S.C. 154(b), the term of this patent shall be extended for 0 days.

(21) Appl. No.: 09/499,570

(22) Filed: Feb. 7, 2000

(51) Int. Cl.[7] ..... H01H 9/28
(52) U.S. Cl. ..... 200/43.16; 224/901.2
(58) Field of Search ..... 200/43.16–43.22; 224/901.2

(56) References Cited

U.S. PATENT DOCUMENTS

D. 372,224 * 7/1996 Larned et al. ..... D13/173
4,506,120 * 3/1985 Fleischman ..... 200/42 R
5,278,365 * 1/1994 Rowley et al. ..... 200/43.16
5,723,832 * 3/1998 Hall ..... 200/43.16

* cited by examiner

*Primary Examiner*—Michael L. Gellner
*Assistant Examiner*—Nhung Nguyen
(74) *Attorney, Agent, or Firm*—Goldstein & Canino

(57) ABSTRACT

A switch manipulation prevention device including a front plate that has a generally square configuration. The front plate has an upper edge, a lower edge, opposed side edges, a front surface, and a rear surface. The front plate has at least one recess extending downwardly of the upper edge. The recess has an open upper end and a closed lower end. The recess is dimensioned for receiving at least one electrical wall switch therein. The front plate is securable to a switch plate whereby the recess is positioned so as prevent movement of the electrical wall switch.

3 Claims, 2 Drawing Sheets

SWITCH MANIPULATION PREVENTION DEVICE

BACKGROUND OF THE INVENTION

The present invention relates to a switch manipulation prevention device and more particularly pertains to preventing a switch from being moved.

Typically, a problem exits when someone mistakenly toggles a switch to either turn an electrical component on or off. What is needed is a simple device that will prevent this problem from occurring while at the same time can be easily removed for normal operation of the switch.

The present invention attempts to solve the abovementioned problem by providing a device that can easily prevent the manipulation of a switch. Additionally, the present invention can be simply removed so as not to obstruct the operation of the switch at times when necessary.

The use of additions to switches are known in the prior art. More specifically, additions to switches heretofore devised and utilized for the purpose of facilitating the operation of a switch are known to consist basically of familiar, expected and obvious structural configurations, notwithstanding the myriad of designs encompassed by the crowded prior art which have been developed for the fulfillment of countless objectives and requirements.

While these devices fulfill their respective, particular objective and requirements, these patents do not describe a switch manipulation prevention device for preventing a switch from being moved.

In this respect, the switch manipulation prevention device according to the present invention substantially departs from the conventional concepts and designs of the prior art, and in doing so provides an apparatus primarily developed for the purpose of preventing a switch from being moved.

Therefore, it can be appreciated that there exists a continuing need for a new and improved switch manipulation prevention device which can be used for preventing a switch from being moved. In this regard, the present invention substantially fulfills this need.

SUMMARY OF THE INVENTION

In the view of the foregoing disadvantages inherent in the known types of additions to switches now present in the prior art, the present invention provides an improved switch manipulation prevention device. As such, the general purpose of the present invention, which will be described subsequently in greater detail, is to provide a new and improved switch manipulation prevention device which has all the advantages of the prior art and none of the disadvantages.

To attain this, the present invention essentially comprises a switch plate adapted for securement over an electrical wall switch. The switch plate has a central opening therethrough to allow for the electrical wall switch to protrude therethrough. A pair of hook and loop strips are secured to the switch plate on opposing sides of the central opening. A front plate is provided that has a generally square configuration. The front plate has an upper edge, a lower edge, opposed side edges, a front surface, and a rear surface. The front plate has a recess extending downwardly of the upper edge. The recess has an open upper end and a closed lower end. The recess is dimensioned for receiving the electrical wall switch therein. The rear surface has a pair of hook and loop strips secured thereto for mating with the pair of hook and loop strips secured to the switch plate whereby the recess is positioned so as prevent movement of the electrical wall switch.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved switch manipulation prevention device which has all the advantages of the prior art additions to switches and none of the disadvantages.

It is another object of the present invention to provide a new and improved switch manipulation prevention device which may be easily and efficiently manufactured and marketed.

It is a further object of the present invention to provide a new and improved switch manipulation prevention device which is of durable and reliable construction.

An even further object of the present invention is to provide a new and improved switch manipulation prevention device which is susceptible of a low cost of manufacture with regard to both materials and labor, and which accordingly is then susceptible of low prices of sale to the consuming public, thereby making such a switch manipulation prevention device economically available to the buying public.

Even still another object of the present invention is to provide a new and improved switch manipulation prevention device for preventing a switch from being moved.

Lastly, it is an object of the present invention to provide a new and improved switch manipulation prevention device including a front plate that has a generally square configuration. The front plate has an upper edge, a lower edge, opposed side edges, a front surface, and a rear surface. The front plate has at least one recess extending downwardly of the upper edge. The recess has an open upper end and a closed lower end. The recess is dimensioned for receiving at least one electrical wall switch therein. The front plate is securable to a switch plate whereby the recess is positioned so as prevent movement of the electrical wall switch.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 2:
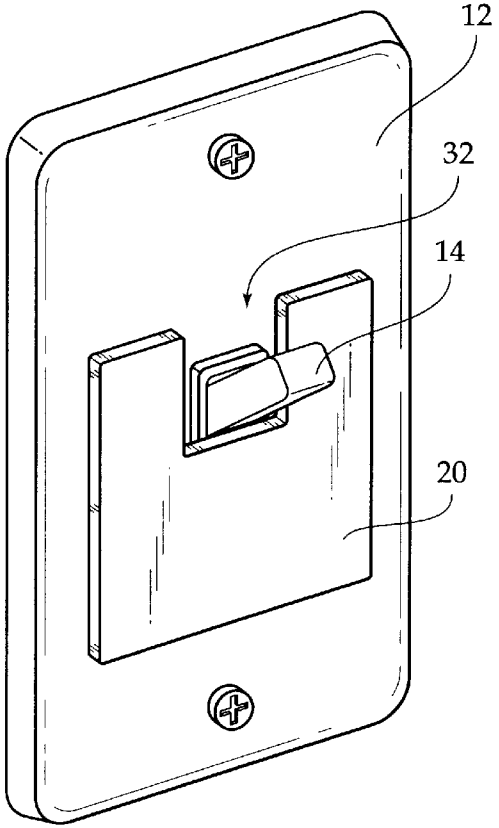
FIG. 2 is a perspective view of the present invention illustrated in use.
Figure 1:
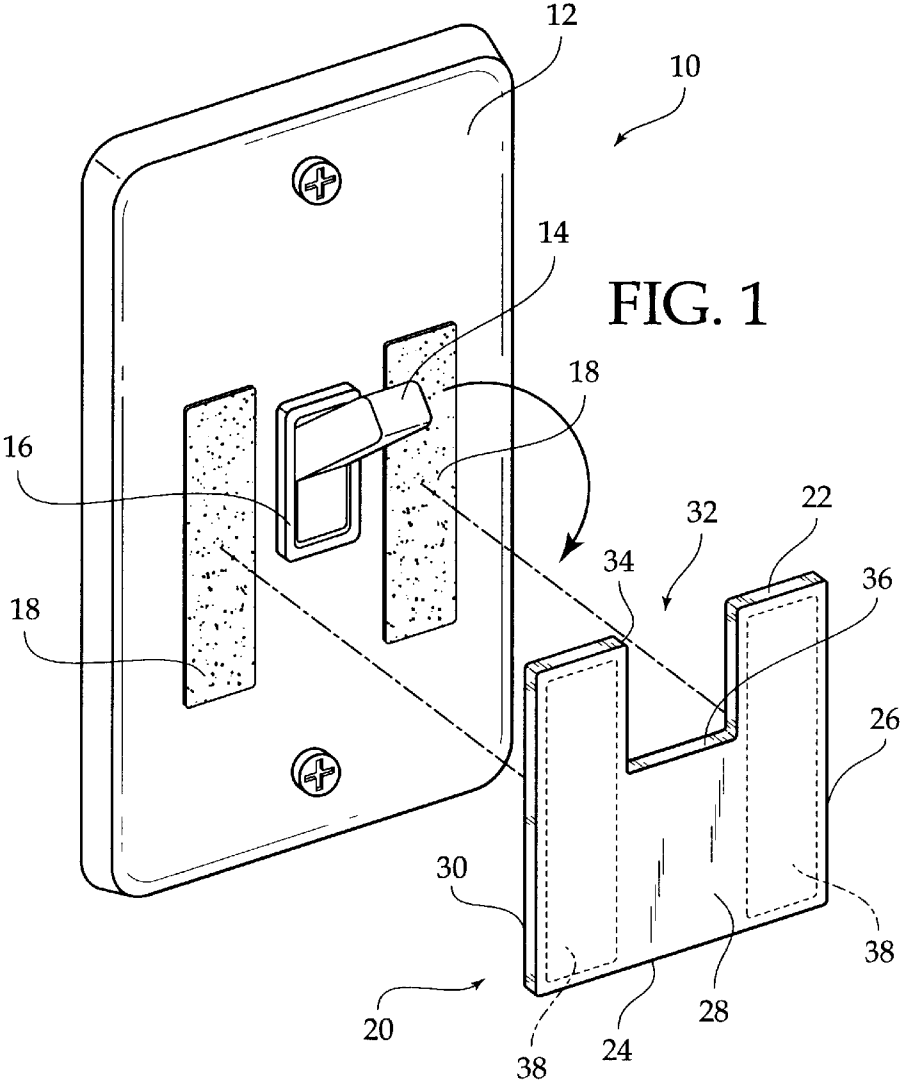
FIG. 1 is a perspective view of the preferred embodiment of the switch manipulation prevention device constructed in accordance with the principles of the present invention.
Figure 3:
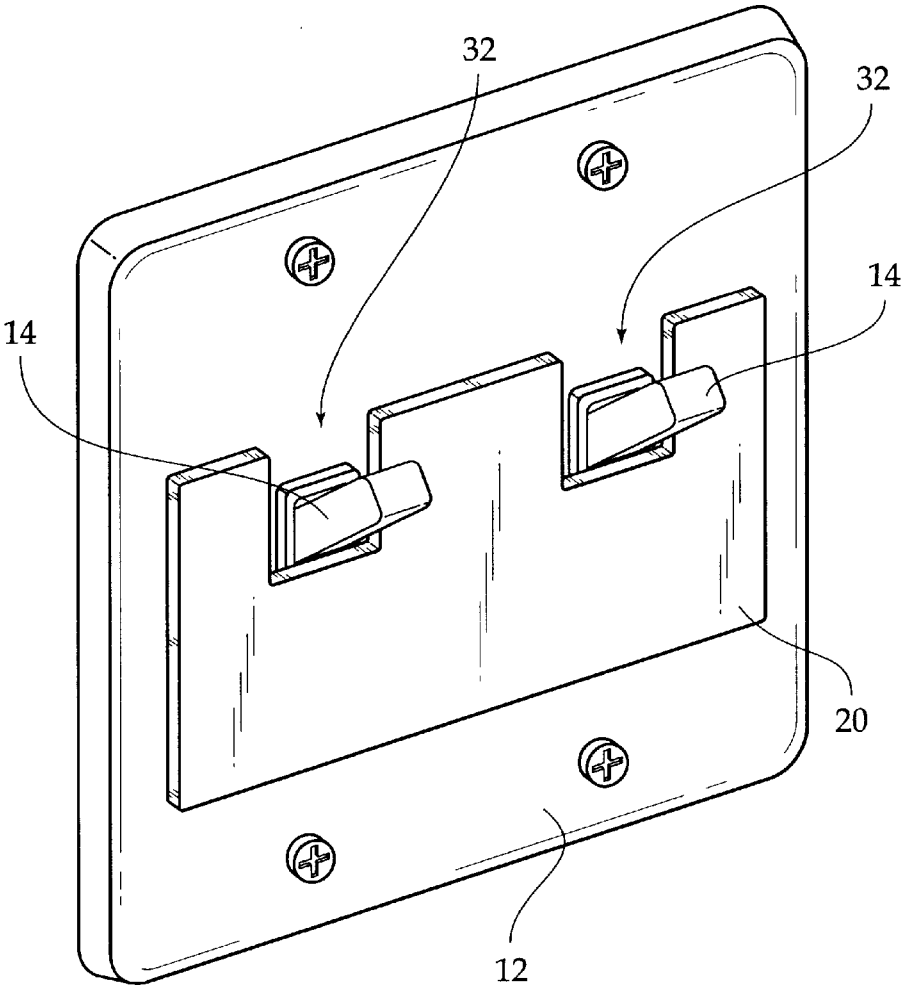
FIG. 3 is a perspective view of a second embodiment of the present invention.

With reference now to the drawings, and in particular, to FIGS. 1 through 3 thereof, the preferred embodiment of the new and improved switch manipulation prevention device embodying the principles and concepts of the present invention and generally designated by the reference number 10 will be described.

Specifically, it will be noted in the various Figures that the device relates to a switch manipulation prevention device for preventing a switch from being moved. In its broadest context, the device consists of a switch plate, a pair of hook and loop strips, and a front plate. Such components are individually configured and correlated with respect to each other so as to attain the desired objective.

The switch plate 12 is adapted for securement over an electrical wall switch 14. The switch plate 12 has a central opening 16 therethrough to allow for the electrical wall switch 14 to protrude therethrough. Note FIG. 1.

The pair of hook and loop strips 18 are secured to the switch plate 12 on opposing sides of the central opening 14. As illustrated in FIG. 1, the strips 18 are vertically oriented and have a length about half of the overall height of the switch plate 12.

The front plate 20 has a generally square configuration. The front plate 20 has an upper edge 22, a lower edge 24, opposed side edges 26, a front surface 28, and a rear surface 30. The front plate 20 has a recess 32 extending downwardly of the upper edge 22. The recess 32 has an open upper end 34 and a closed lower end 36. The recess 32 is dimensioned for receiving the electrical wall switch 14 therein. The rear surface 30 has a pair of hook and loop strips 38 secured thereto for mating with the pair of hook and loop strips 18 secured to the switch plate 12 whereby the recess 32 is positioned so as prevent movement of the electrical wall switch 14. The front plate 20 can be secured to the switch plate 12 with the recess 32 facing up or down with respect to the switch plate 12 so as to prevent the wall switch 14 from being moved upwardly or downwardly.

A second embodiment of the present invention is shown in FIG. 3 and includes substantially all of the components of the present invention further including the use of a switch plate 12 for use with multiple electrical switches 14. In this embodiment, the front plate 20 is provided with a pair of recesses 32 to accommodate both switches 14.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A switch manipulation prevention device for preventing a switch from being moved comprising, in combination:

a switch plate adapted for securement over an electrical wall switch, the switch plate having a central opening therethrough to allow for the electrical wall switch to protrude therethrough;

a pair of hook and loop strips secured to the switch plate on opposing sides of the central opening;

a front plate having a generally square configuration, the front plate having an upper edge, a lower edge, opposed side edges, a front surface, and a rear surface, the front plate having a recess extending downwardly of the upper edge, the recess having an open upper end and a closed lower end, the recess being dimensioned for receiving the electrical wall switch therein, the rear surface having a pair of hook and loop strips secured thereto for mating with the pair of hook and loop strips secured to the switch plate whereby the recess is positioned so as prevent movement of the electrical wall switch.

2. A switch manipulation prevention device for preventing a switch from being moved comprising, in combination:

a front plate having a generally square configuration, the front plate having an upper edge, a lower edge, opposed side edges, a front surface, and a rear surface, the front plate having at least one recess extending downwardly of the upper edge, the recess having an open upper end and a closed lower end, the recess being dimensioned for receiving at least one electrical switch therein, the rear surface coupling with a switch plate whereby the recess is positioned so as prevent movement of the electrical wall switch.

3. The switch manipulation prevention device as set forth in claim 2 wherein a pair of hook and loop strips are secured to the switch plate and the rear surface of the front plate has a pair of hook and loop strips secured thereto for mating with the pair of hook and loop strips secured to the switch plate.

* * * * *